US005454486A

United States Patent [19]

Mack et al.

[11] Patent Number: 5,454,486

[45] Date of Patent: Oct. 3, 1995

[54] SQUEEZABLE DISPENSION CONTAINER FOR FLUID MATERIALS

[75] Inventors: Robert J. Mack, Flemington; James C. McKinney, Cranbury, both of N.J.

[73] Assignee: Colgate-Palmolive Co., New York, N.Y.

[21] Appl. No.: 375,050

[22] Filed: Jan. 18, 1995

Related U.S. Application Data

[63] Continuation of Ser. No. 952,552, Sep. 28, 1992, abandoned.

[51] Int. Cl.[6] ..... B65D 35/28

[52] U.S. Cl. ..... 222/95; 222/105; 222/209

[58] Field of Search ..... 222/94, 95, 105, 222/386.5, 207–212

[56] References Cited

U.S. PATENT DOCUMENTS

| | | | |
|---|---|---|---|
| 2,608,320 | 8/1952 | Harrison | 222/95 |
| 3,580,429 | 5/1971 | Trindle | 222/105 X |
| 3,620,420 | 11/1971 | Normos | 222/386.5 |
| 3,656,660 | 4/1972 | Mueller | 222/94 |
| 4,089,443 | 5/1978 | Zrinyi | 222/386.5 |
| 4,562,942 | 1/1986 | Diamond | 222/386.5 |
| 4,760,937 | 8/1988 | Evezich | 222/105 X |
| 4,842,165 | 6/1989 | Van Coney | 222/105 X |
| 5,012,956 | 5/1991 | Stoody | 222/95 X |
| 5,033,647 | 7/1991 | Smith et al. | 222/212 X |
| 5,271,534 | 12/1993 | Fillmore et al. | 222/386.5 X |
| 5,303,852 | 4/1994 | Yamawaki et al. | 222/386.5 X |
| 5,305,920 | 4/1994 | Reiboldt et al. | 222/95 |
| 5,305,921 | 4/1994 | Kock et al. | 222/95 |
| 5,373,967 | 12/1994 | Grooms et al. | 222/95 |
| 5,377,875 | 1/1995 | Kock et al. | 222/95 |

FOREIGN PATENT DOCUMENTS

| | | |
|---|---|---|
| 2081244 | 12/1971 | France . |
| 2184491 | 6/1987 | United Kingdom . |

*Primary Examiner*—Andres Kashnikow
*Assistant Examiner*—Kenneth R. DeRosa
*Attorney, Agent, or Firm*—Michael J. McGreal; Robert C. Sullivan

[57] ABSTRACT

A dispensing container is produced from a disposable flexible, collapsible inner container surrounded by a resilient outer container. A dispensing cap assembly is removably coupled to the outer container to define a dispensing outlet for the contents of the inner container. The dispensing cap assembly includes a cap having an outlet coupled to the inner container. The inner container is attached to a support hanger which in turn is supported by the outer container. The cap has a dispensing outlet coaxially disposed with the outlet of the inner container. A dispensing check valve is provided in the cap assembly to allow the material to be dispensed without air being drawn into the container at the end of the dispensing cycle. The contents of the inner container are dispensed by squeezing the outer container to deform the side walls and create an increased pressure within the outer container causing the contents to be expelled through the dispensing check valve. The side walls are then allowed to relax which draws air into the container through air inlet check valve. The support hanger includes a depending skirt extending about midway into the outer container. The inner container is attached to the lower end of the skirt and at the upper end of the hanger.

18 Claims, 4 Drawing Sheets

SQUEEZABLE DISPENSION CONTAINER FOR FLUID MATERIALS

This is a Continuation of application Ser. No. 07/952,552, filed Sep. 28, 1992, now abandoned.

FIELD OF THE INVENTION

The present invention is directed to squeezable containers for dispensing fluid materials. More particularly, the invention relates to squeezable dispensing containers having a disposable inner container for the fluid material.

BACKGROUND OF THE INVENTION

Dentifrices and other fluid materials are often packaged in collapsible tubes. These tubes have the advantage of being relatively easy and inexpensive to produce. Consumer acceptance of collapsible tubes has always been somewhat mixed due to the cumbersome nature of the partially used tubes and the difficulty of storage since conventional tubes must lay flat on a horizontal surface. Metal tubes that were first used had the tendency to split or break when too much pressure was applied to the tube while dispensing the contents. With the introduction of plastic laminate tubes, consumer acceptance of tubes was still limited. The plastic laminate tubes have sufficient strength to prevent inadvertent rupture. However, the plastic tubes generally have sufficient memory such that the tubes cannot be rolled up as the product is used, but instead tend to unroll due to the resilient characteristics of the plastics.

As an alternative to tubes, mechanical pumps have been used to dispense fluid materials with some commercial success. These pumps are generally more desirable since they are easier to use and neater to store. The pumps are typically made of a rigid material having a flat bottom to enable the pumps to stand upright and thereby produce a neater appearance during use.

Squeeze bottles have not been particularly successful in dispensing fluid materials such as toothpaste. The highly viscous nature of toothpaste does not easily flow toward the dispensing outlet. The squeeze bottles further draw air into the bottle each time a portion of the contents is dispensed which tends to dry the contents and cause plugging of the dispensing orifice. As more of the contents is dispensed, it becomes progressively more difficult to dispense the contents. In addition, the toothpaste tends to slump to the bottom of the bottle which makes it difficult to dispense the product.

All of the above noted dispensing containers have experienced success in the marketplace. Although the pump-type dispensing containers are easy to use, the expense and difficulty of manufacture has limited the consumer acceptance. In addition, the pump-type devices create large quantities of package waste material when the product has been consumed. Consumer awareness in recent years has shifted to a large extent to consumer goods which have reduced amounts of packaging, thereby reducing the amount of waste at the end of the product's useful life. Attention has also been directed to reusable containers and dispensers which can be refilled, thereby extending the useful life of the container.

Numerous devices have been developed to dispense fluid materials in an easy and convenient manner. One such device is disclosed in U.S. Pat. No. 4,469,250, to Evezich which provides an arrangement using a separate bladder housed within a squeezable outer shell. The shell has a removable cap and nozzle construction. A projection extends inwardly from the base of the nozzle to pierce a foil seal in the bladder to allow dispensing of the contents. Other similar devices for dispensing fluid materials are disclosed in U.S. Pat. No. 4,760,937, and U.S. Pat. No. 4,909,416.

A further example of a pump arrangement for dispensing fluid materials is disclosed in U.S. Pat. No. 4,842,165. This device is a squeeze bottle for dispensing a material without excessive air entrainment between dispensing cycles. The product is suspended in a flexible bag secured at the top end and at its midpoint to the outer container. A suckback valve is located between the dispensing orifice and the flexible bag to prevent air from entering the bag during and between dispensing cycles. An air inlet valve is included in the bottom wall of the container.

The above noted dispensing devices have not been entirely effective in dispensing fluid materials while meeting the consumer needs for cost, ease of use and the environmental concerns for reducing the amount of packaging and disposable containers. There is accordingly a continuing need for squeeze containers for fluid materials. There is further a need for squeeze pump type containers which contain a replaceable inner container to avoid disposing of the entire device.

SUMMARY OF THE INVENTION

The present invention is directed to a squeeze pump container for dispensing fluid materials and in particular toothpaste. More particularly, the invention relates to a squeeze pump dispensing container having a replaceable inner film container which is discarded after the material is dispensed.

The dispensing device is relatively easy to manufacture and use. The container is produced without any complex parts thereby simplifying the manufacturing steps and reducing production costs.

The dispensing device is generally produced from a light weight flexible plastic material. The container essentially includes an outer container having a cap with a dispensing outlet and a flexible bag-like inner container supported within the outer container. When the contents of the inner container have been dispensed, only the inner container is discarded and replaced with a new inner container.

The advantages of the invention are basically attained by producing a squeezable package for dispensing a fluid material comprising a resilient substantially tubular outer container having opposing resilient side walls, a closed bottom wall and an open top end defining an upper edge; an inner container including a hanger and a flexible, collapsible container containing the fluid material, the inner container being supported by the hanger, the inner container being disposed in the outer container, a cap assembly coupled to the upper edge of the outer container and forming a seal between the cap assembly and the outer container and to define an interior space of the outer container, the cap assembly having means defining an axial opening, a first one-way check valve means operatively coupled to said cap assembly and said axial opening, the hanger being coupled to said cap assembly whereby the axial opening and first check valve means are in communication with an interior of the inner container, the first check valve means oriented to allow dispensing of the fluid material from the inner container without foreign material entering the inner container through the first check valve means, and second one-way check valve means on the hanger to allow air to enter the interior space of said outer container without entering the inner container.

Further advantages and objects of the invention are attained by producing a squeezable dispensing assembly for fluid materials comprising: a resilient outer container having opposing resilient side walls, a closed bottom wall to define an interior space and an open top end, the side walls terminating at a top peripheral edge; a cap assembly having an axial outlet means and a peripheral outer edge removably coupled to the outer container and forming a seal between the outer container and cap assembly, an inner collapsible container including a hanger and containing the fluid material, the inner container having side walls, a closed bottom end and a top end connected to said hanger, the inner container disposed within the outer container and supported by the hanger, said inner container defining an inner space communicating with the outlet means; first one-way check valve means coupled to the outlet means of the cap assembly to allow contents of the inner container to be dispensed when exerting inward pressure to the side walls of the outer container; second one-way check valve means disposed on the hanger to allow air to enter the interior space between the inner and outer containers; the hanger having a peripheral edge complementing the side walls of the outer container, the inner container including a skirt depending from the peripheral edge and extending axially about midway into the interior space of the outer container, the skirt terminating at a lower end; and the inner container having a length substantially the length of the outer container, and being attached to the lower end of the skirt about the perimeter and at about the midpoint of the inner container.

Other objects, advantages and salient features of the invention will become apparent from the following detailed description, which, taken in conjunction with the annexed drawings, discloses several embodiments of the invention.

BRIEF DESCRIPTION OF THE DRAWINGS

Referring to the drawings, which form a part of this disclosure.

DETAILED DESCRIPTION OF THE INVENTION

Figure 1:
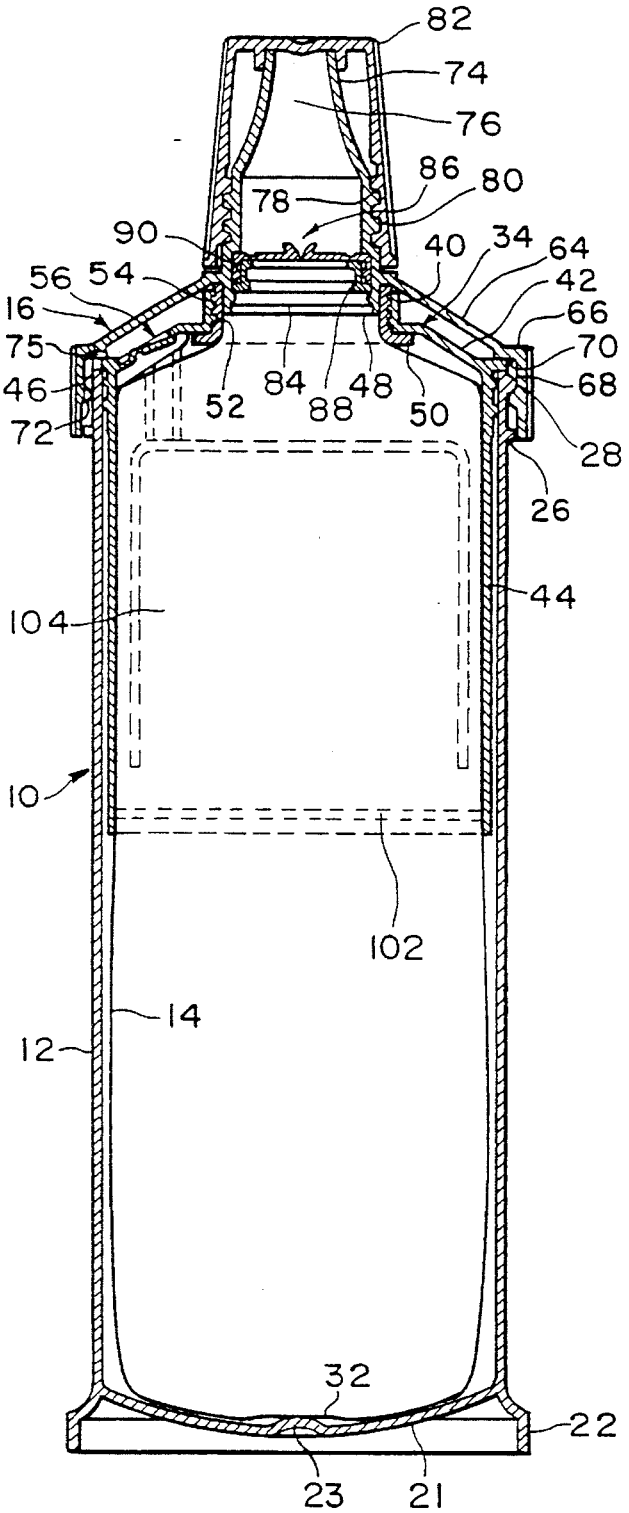
FIG. 1 is a cross-sectional front view of the dispensing device to show the cap assembly with a dispensing valve and an air inlet valve, an inner container and container support, and an outer container.

The disadvantages and limitations of the previous dispensing devices are obviated by the present invention while providing a convenient and environmentally efficient dispensing device. The dispensing device, in accordance with the invention, is a flexible and resilient container which can dispense the contents, and in particular fluid materials, by squeezing the sides of the container. More specifically, the invention relates to a pump-type dispensing container to prevent air from being drawn back into the container at the end of a dispensing cycle. The contents are contained in a disposable inner container which can be replaced when the container is empty.

Referring to the drawings, the dispensing device, in accordance with the invention, is illustrated as a package or dispensing device 10 including an outer container 12, an inner container 14, a hanger 34 supporting the inner container 14, and a cap assembly 16.

Figure 2:
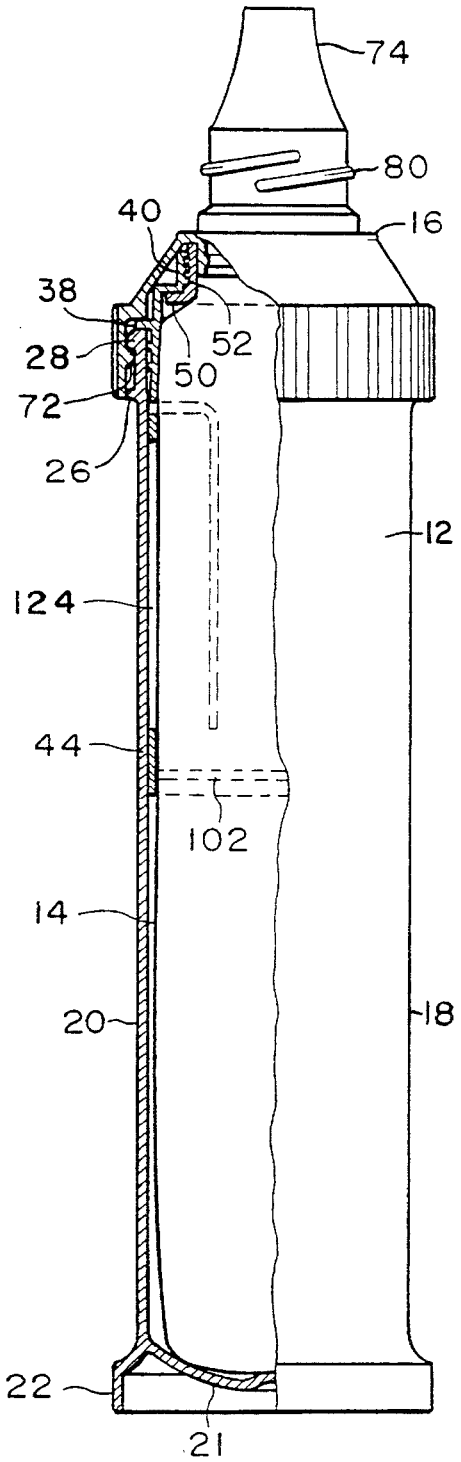
FIG. 2 is a side view of the dispensing device of FIG. 1 with a portion of the outer container cut away to show the cap assembly and the inner container.
Figure 3:
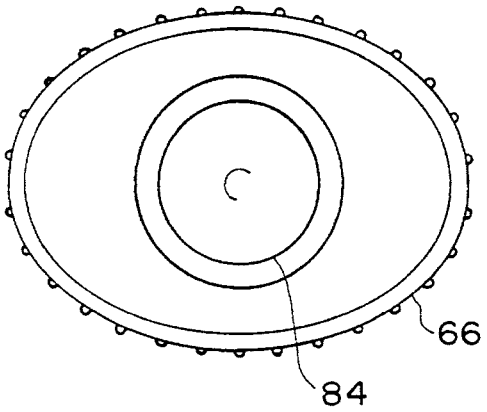
FIG. 3 is a top view of the cap assembly as seen from the top end of FIG. 1.
Figure 4:
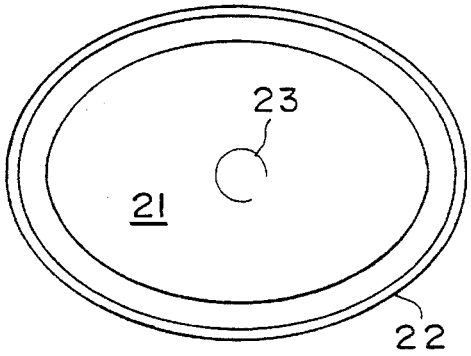
FIG. 4 is a bottom plan view of the cap assembly as seen from the bottom of FIG. 1.

The outer container 12 comprises a resilient body portion formed from a resilient polymeric material. In a preferred embodiment of the invention, as shown in FIGS. 1 and 2, the outer container has a substantially elliptical cross-sectional shape to define a major axis and a minor axis. The outer container comprises a pair of opposing flexible walls 18 and 20 as shown in FIG. 2, which are squeezed to dispense the contents of the dispensing device as discussed hereinafter in greater detail. The outer container further includes a closed bottom wall 21 and a base portion 22 to enable the container to stand in an upright position. As illustrated in FIG. 1, the bottom wall 21 is curved and has an optional inwardly directed dimple 23. An upper end of the outer container 12 includes two parallel, spaced-apart outwardly directed collars 26 and 28 extending around the perimeter of the upper end. Collar 28 interfits with projection 72 of the cap assembly 16 to provide a snap fit of the cap assembly onto the outer container. Collar 26 functions as a support ring. Both collars 28 and 26 have intermittent grooves so that air can pass by these collars. As best illustrated in FIG. 2, the inner surface of the side wall of the outer container 12 is substantially smooth with no interruptions.

The outer container 12 in preferred embodiments is molded from a plastic material as a single unit. The side walls 18 and 20 are resilient to withstand repeated flexing during the dispensing cycle and are able to readily return to their original shape and position.

The inner container 14 which contains the fluid material to be dispensed is preferably in the form of a collapsible bag having a closed bottom end 32 and an open upper end. The inner container 14 may be made from a flexible polymeric film or metal film as known in the art. The inner container may be formed from a sheet material folded over on itself and sealed along its length or formed by extruding as a one-piece unit. In all events, the inner container is sufficiently flexible to be easily deformed to expel the contents of the inner container by applying a lateral force through the resilient walls 18, 20 of the outer container 12. The inner container 14 is preferably dimensioned to conform substantially to the inner dimension of the outer container 12 and has a length substantially equal to the length of the outer container 12. The upper end of the inner container is coupled to a hanger 34 through which the contents are dispensed. The bottom end 32 of the inner container 14 is either continuous or closed to prevent the contents of the inner container from leaking into the interior of the outer container.

Figure 5:
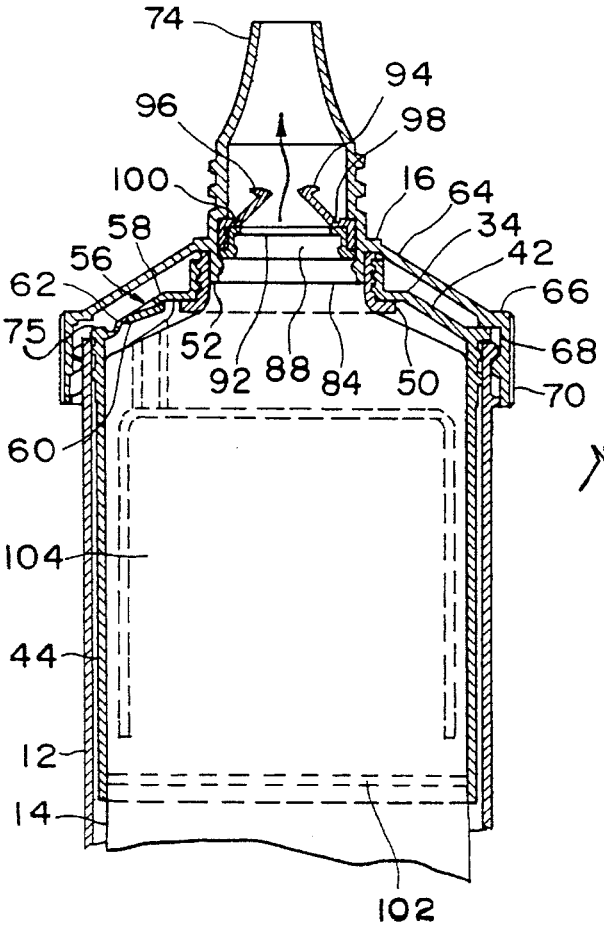
FIG. 5 is a cross-sectional view of the cap assembly showing the dispensing valve in an open position during a dispensing cycle when pressure is exerted on the walls of the outer container.
Figure 6:
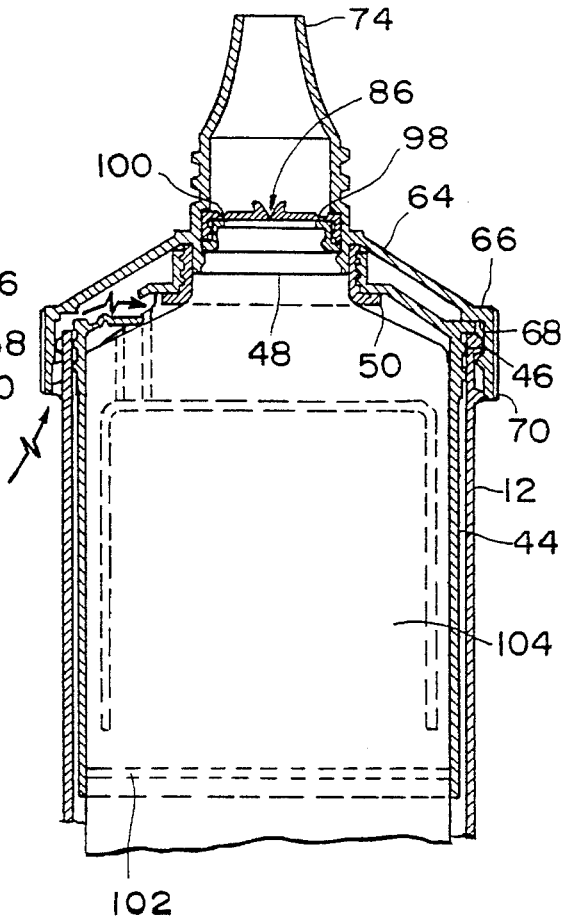
FIG. 6 is a cross-sectional view of the cap assembly with the dispensing valve in the closed position and the air inlet valve in the open position allowing air to enter the outer container when the dispensing pressure on the walls of the outer container is released.

The hanger 34 includes a radially extending flange 38 dimensioned to accommodate the upper end of the outer container 12 as shown in FIG. 2. The hanger is further described in FIGS. 2, 5 and 6. An axially extending collar 40 extends upwardly to define a dispensing outlet and is interconnected to the radial flange 38 by a radial shoulder portion 42 as shown in FIGS. 5 and 6. A depending skirt 44 extends downwardly from the hanger 34 in an axial direction opposite the collar 40 as shown in FIG. 1. The skirt 44 is preferably dimensioned to fit in a closely spaced relationship with the inner surface of the outer container 12. A pair of continuous radial ridges 46 extend around the outer perimeter of the upper end of skirt 44 to provide a sealing means against the walls of the outer container 12. The ridges 46 are preferably dimensioned to form a substantially airtight seal against the inner surface of the outer container 12.

The inner container 14 includes an open upper end 48 attached to a collar 50 to define a dispensing outlet for the inner container. The inner container 14 may be attached to an annular collar 50 of the hanger 34 by any suitable means such as thermal or adhesive bonding. The annular collar 50 is then coupled to the inner surface of the collar 40 as shown in FIGS. 1, 5 and 6. The annular collar 50 is generally permanently attached to the collar 40 of the hanger 34 by welding or by means of an adhesive. Alternatively, the annular collar 50 may have external threads or detents 52 which interlock with complementing detents 54 on the inner face of the collar 40 to form a snap connection. The use of detents provides for an ease of assembly of the inner container 14 via collar 50 onto collar 40.

Referring to FIGS. 5 and 6, a one-way check valve 56 is disposed in the radial portion 42 of the hanger 34 which serves as an air inlet to the space between the outer container 12 and the inner container 14. In one preferred form of the invention, the check valve 56 includes an opening in the radial portion 42 to define a valve seat 58 as shown in FIG. 5. A flapper-type valve 60 is hinged to an inner surface of the hanger 34 to seal against the valve seat 58 in the closed position. The valve 60 is in one embodiment integrally formed with the hanger 34 and connected thereto by a living hinge 62. An alternative is to partially seal a film around the edge of the opening to form the valve. As shown in FIGS. 5 and 6, the valve 60 is mounted to pivot inwardly toward the interior of the hanger 34 when in the open position. This flap valve arrangement is advantageous for its simplicity of construction and operation, although other conventional valve arrangements may also be used. In preferred embodiments, the valve 56 assumes the closed position when the pressure within the outer container 12 is equal to the pressure outside the outer container.

The cap assembly 16 is dimensioned to fit over the hanger 34 and the upper edge of the outer container 12. In the preferred embodiments, the assembly 16 includes a generally conical shaped portion 64 extending outwardly to a peripheral edge 66. The peripheral edge 66 of the cap assembly 16 includes a substantially planar inner face 68 and an axial collar 70. An annular rib 72 extends inwardly from the inner face of the collar 70 to complement the rib 28 on the outer container 12 to removably couple the cap assembly 16 to the outer container 12 by a snap connection. Generally, the collar 70 of the outer cap is dimensioned to complement the outer dimension of the outer container 12 to form a seal between the cap assembly 16 and the outer container 12. As shown in FIG. 1, the rib 26 engages the inner surface of the collar 70 of the cap assembly.

A dispensing nozzle 74 is connected to the conical portion 64 of the cap assembly and defines an axial outlet passage 76 for the material to be dispensed. The dispensing nozzle 74 extends axially from the cap assembly 16 and preferably includes external threads 78 for mating with internal threads 80 of the removable over cap 82. An axial collar 84 extends from the cap assembly 16 in a direction opposite the dispensing nozzle 74 toward the hanger 34. The axial collar 84 has an outer dimension complementing the inner dimension of the collar 50 on the hanger 34 to form a substantially fluid-tight seal between the hanger 34 and cap assembly 16. An air vent 75 is included on the outer edge of the cap assembly 16 to allow air to enter the space between the cap assembly and the hanger. The air vent 75 as shown in FIG. 5 is a groove in the edge of the cap. As previously noted, a suitable groove is also provided in the ribs 26, 28 to allow air to pass through the vent 75. In alternative embodiments, the vent 75 extends through the outer face of the cap 16.

A material dispensing one-way check valve assembly 86 can be disposed in the cap assembly 16 in the axial outlet passage 76. In the embodiment shown in FIGS. 1, 2, 5 and 6, the check valve assembly 86 is formed as a separate unit and assembled into the cap assembly 16 by sliding the check valve assembly 86 into an axial groove. A retaining ring 88 is included in the inner surface of the inner axial groove to retain the check valve assembly in position. The check valve assembly 86 includes an annular collar 90 to define an axial opening. This collar 90 also serves to bias the valve to a closed position. As shown in FIGS. 5 and 6, a pair of opposing flap valves 94 and 96 (see FIGS. 5 and 6) are hinged from opposite sides of the check valve assembly. The flap valves 94 and 96 have a generally semi-circular shape with their straight sides facing each other. The valves 94 and 96 are hinged to the collar 90 to pivot outwardly to an open position as illustrated in FIG. 5 and to pivot downwardly in a closed position as illustrated in FIG. 6. In preferred embodiments, the flap valves 94 and 96 are connected to the check valve assembly by living hinges 98 and 100. In the embodiment of FIG. 5, the flap valves 94, 96 are substantially co-planar when in the closed position. Upward projections 92 prevent the flap valves 94 and 96 from moving downwardly past a substantially horizontal position.

In preferred embodiments, the dispensing check valve 86 comprises the two cooperating flap valves hinged at opposite sides. The twin flap valve arrangement has been found to open and close easily during use compared to single flap valves or other valve arrangements. The twin flap valve arrangement allows for a wider opening with reduced force on the outer container needed to dispense the product, and allows for faster and easier closing of the valve to reduce slumping of material and the drawing of air through the valve. The valve is self closing at the end of the dispensing cycle.

The outer container 12 is generally formed of a resilient material such that the side walls 18 and 20 can be deflected inwardly by a dispensing force and have the side walls returned to their relaxed position when the dispensing force is removed. The hanger 34 is preferably preassembled with the inner container 14 and slid into the outer container 12 until the flange 38 of the hanger 34 rests against the top end of the outer container as shown in FIGS. 1, 5 and 6. The peripheral ridges 46 on the skirt 44 of the hanger 34 form a substantially air-tight seal between the hanger 34 and the outer container 12. The cap assembly 16 is then placed over the hanger 34 such that the axial collar 48 extends into the open upper end of collar 50. The axial collar 70 of the cap assembly 16 slides over the outer face of the outer container 12 such that the rib 28 on the outer container and the rib 72 on the axial collar 70 interlock to secure the cap assembly 16 on the outer container 12. An overcap 82 is threaded onto nozzle 74.

In operation, the user squeezes the side walls 18 and 20 of the outer container 12 to exert a dispensing pressure on the inner container 14. The contents of the inner container 14 are forced outwardly through the check valve 86 toward the nozzle 74 by the dispensing pressure until a desired amount of the contents has been dispensed, as shown in FIG. 5. The dispensing force on the side walls 18 and 20 of the outer container is then released which allows the side walls to return to their relaxed position and to cause a slight sucking action through the nozzle 74. Referring to FIG. 6, as the dispensing pressure is released and the material in the nozzle starts to be drawn back into the inner container 14, the check valve 86 quickly closes to prevent excessive amounts of material and air from being drawn into the inner container 14. The closing of the check valve 86 produces a reduced pressure in the space between the inner container 14 and the outer container 12 due to the resilient side walls 18 and 20 which draws external air through the air vent 75 to the space between the hanger 34 and the cap assembly 16 and then through the check valve 56 to the interior of the outer container 12. The outer container 12 thereby returns to its original shape while the inner container 14 remains collapsed. The dispensing cycle may be repeated numerous times until the contents of the inner container 14 have been expelled through the nozzle 74. The inner container 14 thus collapses with each successive dispensing cycle since air is not drawn back into the container when the dispensing force is released from the outer container. Since the inner container is attached to the skirt 44 at the lower periphery of the skirt, container 14 will invert up into the skirt during dispensing.

Initially, when the inner container 14 is completely full with material to be dispensed, the side walls 18 and 20 of the outer container physically contact the inner container 14 to compress the side walls of the inner container and dispense the contents. As the contents of the inner container 14 are dispensed and the side walls 18, 20 of the outer container 12 are not able to engage the walls of the inner container, the dispensing force applied to the outer walls 18 and 20 produces an increased air pressure on the inner container 14 to dispense the material.

Once the contents of the inner container have been completely dispensed, the cap assembly 16 is removed from the outer container 12 and the hanger 34. The hanger and the attached empty inner container 14 are then removed from the outer container 12. The hanger 34 and the inner container 14 may be discarded as an assembly, or alternatively, the inner container 14 may be separated from the hanger 34 and discarded. In all events, a new inner container and hanger may then be positioned in the outer container 12 and the cap assembly 16 attached to the container 12. The new inner container and hanger as a container assembly can be packaged and sold separately from the remainder of the dispensing device. In preferred embodiments, the new inner container assembly includes a suitable seal to close the open end, such as a peelable foil seal or a film seal which can be punctured by the collar 84 of the cap assembly 16. The cap assembly 16 and the outer container 12 thus provide a reusable dispensing assembly which can be reused and refilled numerous times.

In preferred embodiments of the invention, the skirt 44 depending from the upper part of hanger 34 forms a sleeve which has an axial length to extend approximately midway into the outer container 12 as shown in FIGS. 1 and 2. The sleeve is generally formed from a resilient polymeric material which can be bent inwardly to directly or indirectly compress the inner container 14 by applying a dispensing force to the outer walls of the outer container 12 and return to its original shape when the dispensing force is released. The inner container 14 is positioned within the skirt 44 and coupled to the collar 50 defining the axial opening of the hanger 34. The inner container 14 in a preferred embodiment is secured to the lower edge of the skirt 44 around the perimeter of the inner container 14 by means of a suitable adhesive 102.

Figure 7:
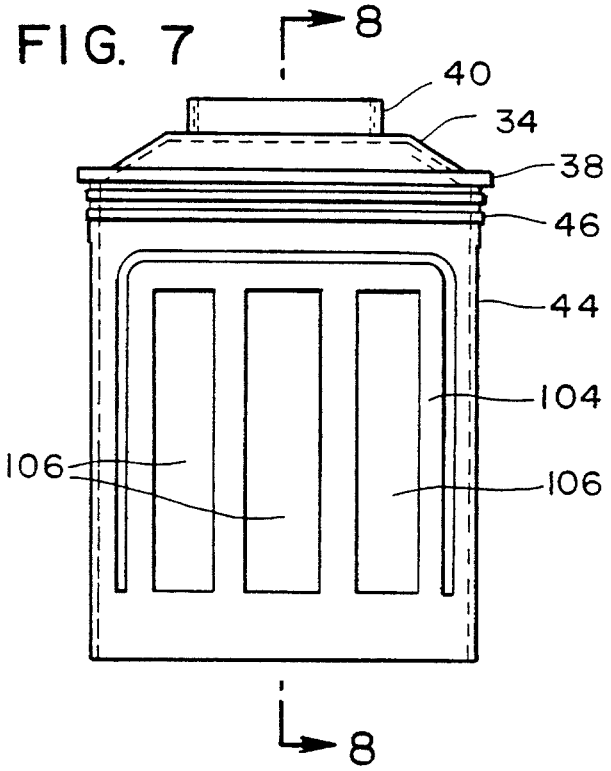
FIG. 7 is a front view of the hanger support including a depending skirt having a window flap hinged at a lower end of the skirt in accordance with one embodiment of the invention.
Figure 8:
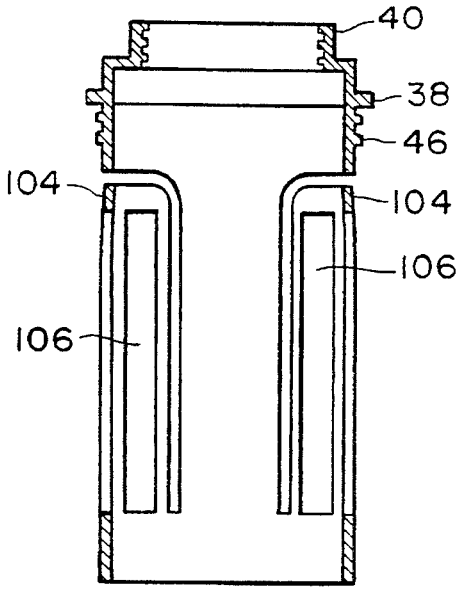
FIG. 8 is a cross-sectional view of the hanger as seen along line 8—8 of FIG. 7.
Figure 9:
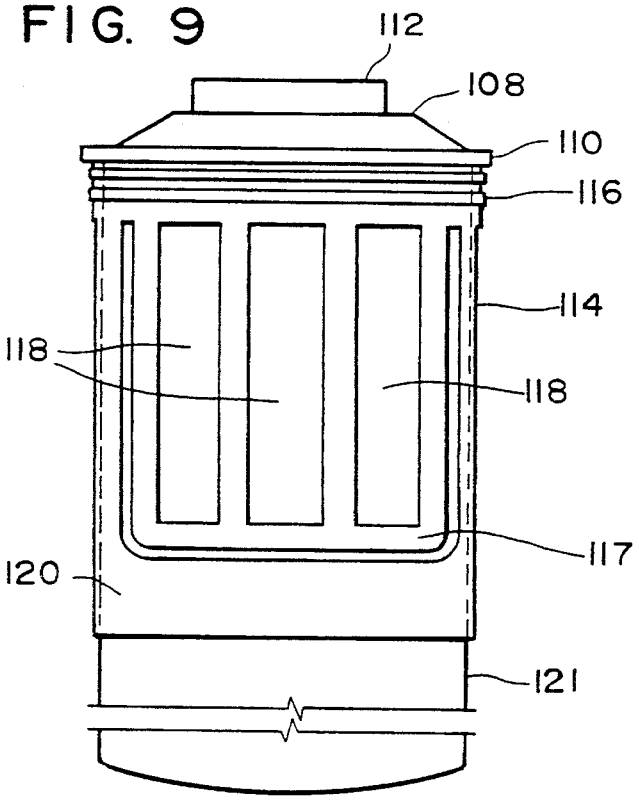
FIG. 9 is a front view of the hanger where the hanger includes a depending skirt having a flap hinged to an upper end of the skirt in accordance with an alternative embodiment of the invention.

The skirt 44 can be formed to include hinged flaps 104 on opposing sides of the skirt 44 as shown in FIG. 1. The hanger flap 104 has a width and a length approximately the width and length of the skirt 44. In preferred embodiments, the hanger flap 104 is hinged to the skirt 44 at its lower end. The hanger flap 104 may be a solid element 124 as shown in FIGS. 1–6 or may include one or more apertures 106 as shown in FIGS. 7–9. In preferred embodiments, the dispensing container has a substantially elliptical cross-sectional shape with the flaps oriented along the major axis of the ellipse.

Figure 10:
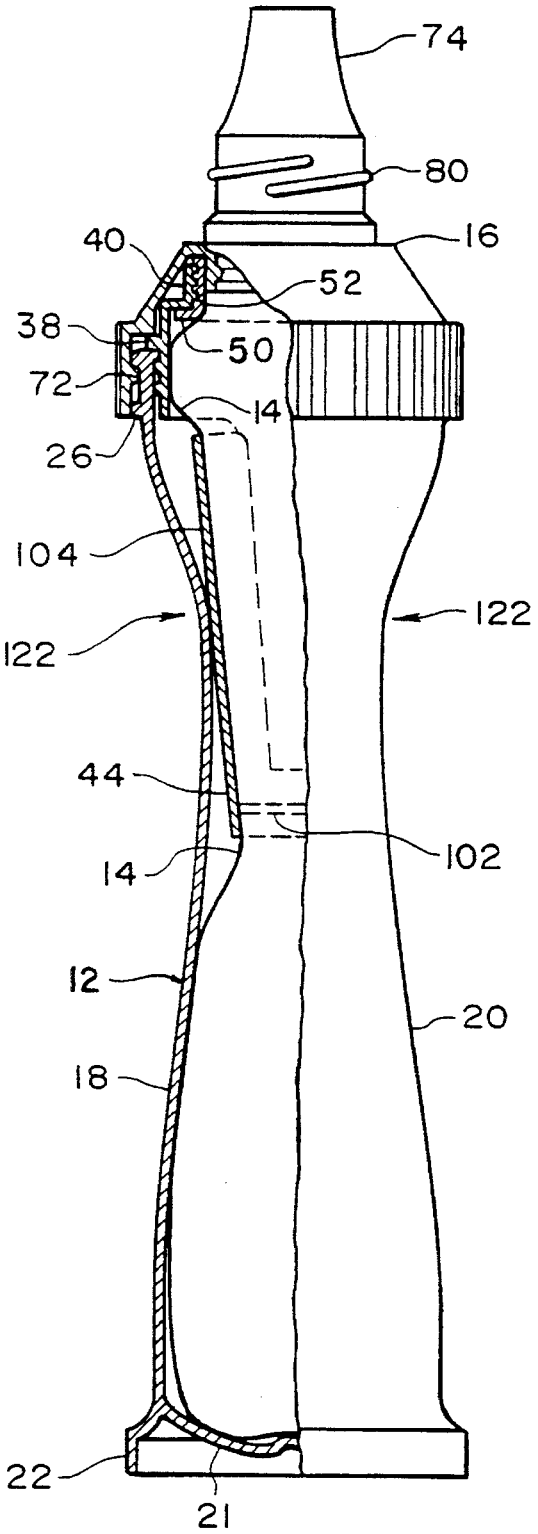
FIG. 10 is a side view of the dispensing device of FIG. 1 during a dispensing cycle in the collapsed condition showing the hinged flap on the depending skirt of the inner container support.

The use and operation of the dispensing device is essentially as discussed above. Basically, the inner container 14 containing the material to be dispensed is attached to the hanger 34 at the open upper end of the inner container 14. The inner container 14 is then attached to the lower end of the skirt 44 about the perimeter of the inner container by an adhesive 102. In preferred embodiments, the inner container 14 is attached to the lower end of the skirt 44 at about a mid-point of the axial length of the inner container 14. The inner container 14 and the hanger 34 are then assembled into the outer container 12 by sliding the inner container 14 and skirt 44 into the outer container until the flange 38 mates with the upper end 24 of the outer container 12. The cap assembly 16 is then attached to the hanger 34 and the outer container 12. The material within the inner container 14 is dispensed by applying a lateral dispensing force to the outer walls of the outer container 12. During the dispensing cycle, the check valve 56 is in the closed position such that the dispensing force produces an increased air pressure within the outer container 12 which along with a direct contact thus causes the material to be dispensed through the check valve 86. During the dispensing cycle, the opposing side walls 18 and 20 of the outer container 12 deflect inwardly to engage the skirt 44 and the flap 104 as illustrated in FIG. 10. The flap 104 is hinged at the lower end of the skirt 44 so as to pivot inwardly with respect to the skirt 44 by the dispensing force to apply a mechanical pressure to the inner container 14 to provide a more uniform and controlled dispensing of the material within the container 14. When the dispensing force is applied to the mid-section of the outer container 14 as indicated by arrows 122, the outer walls 18, 20 engage the lower edge of the skirt 44 to deflect the skirt 44 inwardly to compress the inner container 14. The dispensing force also will push the flaps 104 toward each other and will reduce the force needed to dispense material from inner container 14.

Once the desired amount of material has been dispensed from the nozzle 74, the opposing dispensing force is removed from the resilient outer wall of the outer container 12. The resilience of the outer container 12 and the resilience of the skirt 44 and flap 104 causes the outer container 12 and skirt 44 to return to their original shape. Since the inner container 14 is secured about its perimeter to the skirt 44, the inner container 14 at its midpoint is also returned to its original shape. The resilience of the container 12 and the skirt 44 in returning to their original shape create a reduced pressure within the inner container 14 and the outer container 12 to immediately stop the flow of material through the dispensing nozzle 74. The reduced pressure in the inner container 14 causes a small amount of the material to be drawn back in through the nozzle 74 which immediately closes the check valve 86 to prevent air being drawn into the inner container 14. As the dispensing force is released from the outer container 12, the check valve 56 immediately opens to allow air to be drawn into the outer container 12, as shown in FIG. 6. As illustrated, air is drawn through the vent 75 between the cap assembly 16 and the outer container 12 and then through the check valve 56. With each dispensing cycle, the contents are dispensed and the container collapses. At the end of each dispensing cycle, the check valve 86 immediately closes to prevent material from entering the inner container 14. Since the inner container 14 is attached to the lower end of the skirt 44 and the resilience of the skirt causes the midsection of the inner container to return to its original undeflected position, the bottom end of the inner container 14 tends to be drawn upwardly toward the dispensing nozzle to eventually attain an inverted form. The collapsing of the inner container 14 maintains the material at the upper end of the inner container 14 toward the dispensing nozzle 74. The self closing dispensing valve 56 prevents air from being drawn into the inner container and prevents slumping of the contents to the bottom of the inner container. This provides more efficient dispensing of the material as the amount of material in the inner container 14 is reduced. The flaps 104 on the skirt 44 continue to exert a mechanical pressure onto the inner container 14 when the walls of the outer container are compressed even though the inner container may be partially collapsed since the inner container tends to invert and keep the contents in the upper portion of the inner container 14. The mechanical force applied by the flaps 104 provides more efficient dispensing than by air pressure alone.

After the dispensing cycle, the dispensing device may be stored in an upright position on its base 22 until its next use. The check valve 86 has a normally closed position to prevent slumping of the material to the bottom of the inner container and to prevent air from entering the container which may cause sputtering during the subsequent dispensing cycle. In addition, the check valve 86 retains a small amount of the material in the dispensing nozzle 74 to provide an instantaneous discharge of material at the next dispensing cycle.

In a further embodiment of the invention, the inner container may include a hanger 108 as illustrated in FIG. 9. The hanger 108 is similar in several aspects to the hanger 34 comprising a radial flange 110, an axial collar 112 defining an outlet, a depending skirt 114 and annular ridges 116 extending around the perimeter of the skirt. A pair of opposing hanger flaps 117 are formed in opposing sides of the skirt 114 and are hinged to the skirt 114 at an upper end adjacent the flange 110. A plurality of apertures 118 can be formed in the flaps 117. The hanger 108 is coupled to an inner flexible container and an outer container by an outer cap assembly in a manner similar to the previous embodiment. The use and operation of the dispensing in accordance with this embodiment is essentially the same as previously discussed with the exception of the flap 116 pivoting inwardly from the upper end of the hanger 108 to engage the collapsible inner container and dispense the contents. In this embodiment it is generally preferred to have the mid section of the inner container 121 securely attached to the lower end 120 of the skirt 112 so as to prevent the lower end of the flap from interfering with the collapse and inversion of the inner container.

The dispensing device in accordance with the invention has the advantage of providing a simple and inexpensive means for dispensing fluid materials through a pump type action. In addition, the dispensing device has the further advantage of providing a dispensing device which can accept a replaceable inner container to refill the device. In preferred embodiments, the hanger and the collapsible inner container are produced as an assembly which can be replaced when the contents have been dispensed. By producing the hanger and the inner container as a disposable unit, the air inlet check valve is replaced with each refill to ensure proper operation of the dispensing device. Furthermore, the inner container can be produced from a thin flexible material which collapses when the contents are spent which reduces the volume of waste material which is thrown away. The cap assembly with the dispensing valve and the outer container are thus retained for reuse.

Figure 11:
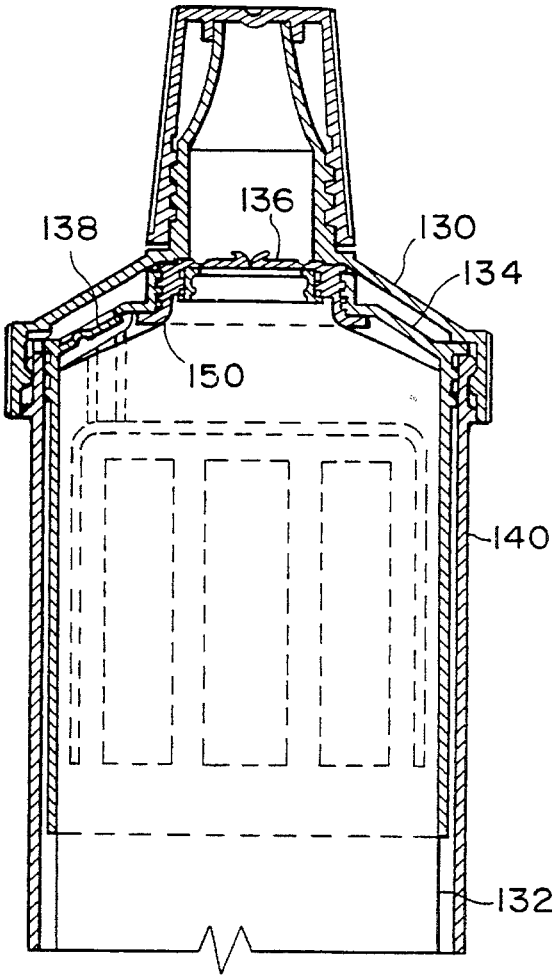
FIG. 11 is a cross-sectional view of a further embodiment of the dispensing device showing the dispensing valve and the air inlet valve on the hanger of the inner container.

In a further embodiment as illustrated in FIG. 11, the dispensing device includes a cap assembly 130 and inner container assembly comprising a collapsible inner container 132 and hanger 134. A dispensing check valve 136 is positioned in the upper end of the hanger and supported by collar 150. An air inlet check valve 138 is formed in the shoulder of the hanger. The remaining portions of the hanger, cap assembly and outer container 140 are similar to the embodiment of FIG. 1. The operation of the dispensing device is also substantially the same. In this embodiment, the collapsible inner container 132 is attached to the hanger 134 as an assembly such that the assembly is discarded when empty and replaced with a refill assembly. The dispensing outlet valve and air inlet valve being part of the hanger are replaced with the inner container to ensure proper operation of the valve during use.

In further embodiments, the inner container is attached to a collar which is separable from the hanger. In this embodiment, the hanger may be retained for further use so that the only waste material is the inner container and the collar.

Generally, the hanger 34, skirt 44 and the inner container are dimensioned to complement the inner dimensions of the outer container 12. In an alternative embodiment, the skirt 44 and the hanger are shaped slightly different or smaller than the inner dimension of the outer container 12. This provides means to allow air within the outer container to escape when the inner container is inserted into the outer container.

The present invention has been described as a resilient squeeze container for dispensing fluid materials and in particular a dentifrice paste. It is to be recognized by those skilled in the art that the dispensing device can be used for a variety of fluid materials where the controlled dispensing of the material is desired. The invention has further been described in terms of the preferred embodiments and specific structural features. It is to be recognized that the specific design of many of these structural elements may be modified by one skilled in the art depending on the needs to dispense the desired material. It will be obvious to those skilled in the art that numerous changes and modifications can be made to the dispensing device without departing from the spirit and scope of the invention.

What is claimed is:

1. A squeezable package for dispensing a fluid material comprising:

a resilient substantially tubular outer container having opposing resilient side walls, a closed bottom wall and an open top end defining an upper edge;

an inner container including a hanger supported on the upper edge of said outer container and a flexible, collapsible container containing said fluid material having a closed bottom end and an open top end and supported by said hanger, said inner container being disposed in said outer container;

a cap assembly coupled to said upper edge of said outer container and forming a seal between said cap assembly and said outer container and to define an interior space of said outer container, said cap assembly having means defining an axial opening, a first one-way check valve means operatively coupled to said cap assembly and said axial opening, said hanger being coupled to said cap assembly whereby said axial opening and said first check valve means are in communication with an interior of said inner container, said first check valve means oriented to allow dispensing of said fluid material from said inner container without foreign material entering said inner container through said first check valve means, and second one-way check valve means disposed on and a part of the hanger to allow air to enter the interior space of said outer container without entering said inner container.

2. The package according to claim 1, said outer container having a substantially elliptical shaped cross-section defining a major axis and a minor axis, and said opposing resilient side walls being disposed along said major axis.

3. The package according to claim 1, said hanger comprising a peripheral edge complementing the side walls of said outer container, a first portion extending radially inwardly from said peripheral edge and terminating at a second axial opening, and a skirt depending from an upper portion of said hanger and extending axially about midway into the interior space of said outer container, said skirt terminating at a lower end.

4. The package according to claim 3, said second valve means comprising a flap valve means hinged to said first portion of said hanger and disposed on an inner surface to allow air to enter said interior space of said outer container.

5. The package according to claim 1, said hanger being removably coupled to said outer container and said cap assembly.

6. The package according to claim 3, wherein said collapsible container is a flexible bag and extends beyond an axial length of said skirt.

7. The package according to claim 6, said collapsible container being attached to said lower end of said skirt about its perimeter at about a midpoint of said collapsible container.

8. The package according to claim 3, said cap assembly further comprising a nozzle and an overcap removably coupled to and enclosing said nozzle.

9. The package according to claim 1, said first check valve means comprising first and second flap valve means hinged to opposing sides of a valve support and being movable from an open to a closed position.

10. A squeezable dispensing device for fluid materials comprising:

a resilient outer container having opposing resilient side walls, a closed bottom wall to define an interior space and an open top end, said side walls terminating at a top peripheral edge;

a cap assembly having a peripheral outer edge removably coupled to said top edge of said outer container and forming a seal between said outer container and cap assembly, said cap assembly including axial outlet means;

an inner container including a hanger and a collapsible container supported by said hanger and containing said fluid material, the collapsible container having side walls, a closed bottom end and a top end connected to said hanger, said collapsible container disposed within said outer container and defining an inner space communicating with said outlet means;

first one-way check valve means coupled to said outlet means of said cap assembly to allow contents of said collapsible container to be dispensed when exerting inward pressure to said side walls of said outer container;

second one-way check valve means disposed on and a part of said hanger to allow air to enter said interior space of said outer container;

said hanger supported on the top peripheral edge of said outer container and having a hanger peripheral edge complementing the side walls of said outer container, and a skirt depending from said hanger peripheral edge and extending axially about midway into the interior space of said outer container, said skirt terminating at a lower end; and said collapsible container having an axial length greater than the axial length of said skirt, and being attached to said skirt about the perimeter and at about the midpoint of said container.

11. The dispensing device of claim 10, wherein said depending skirt is integrally formed with said hanger, said cap assembly further comprising vent means to allow air to enter a space defined between said cap assembly and hanger whereby air can pass through said second valve means.

12. A squeezable dispensing assembly for fluid materials comprising:

a resilient outer container having opposing resilient side walls, a closed bottom wall to define an interior space and an open top end, said side walls terminating at a top peripheral edge;

an inner collapsible container disposed in said outer container and defining an inner space containing said fluid material and having side walls, a closed bottom end and a top end coupled to a hanger, the hanger including first outlet means and being removably coupled to an upper surface of said outer container and forming a substantially air-tight seal between said outer container and said hanger;

a cap assembly having a peripheral outer edge and second axial outlet means, said cap assembly being removably coupled to said hanger and said outer container;

first one-way check valve means disposed in said first outlet means of said hanger for dispensing contents of said inner container;

second one-way check valve means disposed on said hanger to allow air to enter said interior space of said outer container.

13. The device according to claim 12, wherein said hanger includes a peripheral edge complementing the side walls of said outer container, and a skirt depending from said peripheral edge and extending axially about midway into the interior space of said outer container, said skirt terminating at a lower end; and said inner container having a length substantially the length of said outer container, and being attached to said lower end of said skirt about the perimeter and at the midpoint of said inner container.

14. The dispensing assembly according to claim 12, said first check valve means comprising first and second flap valve means hinged to opposing sides of a valve support and movable from an outward open position to an inward closed position.

15. The dispensing assembly according to claim 13, wherein said skirt is resilient and includes opposing side walls closely spaced to said side walls of said outer container, each said side wall of said skirt including hinged flap means for pivoting inwardly to engage said inner collapsible container and dispense contents when applying dispensing pressure to said side walls of said resilient outer container.

16. The dispensing assembly according to claim 15, each said flap means being hinged to said side wall of said hanger at said lower end of said skirt, said flap means being disposed to pivot inwardly to engage said inner collapsible container and dispense material through an outlet when exerting pressure to said flexible side walls of said outer container.

17. The dispensing assembly according to claim 15, each said flap means having a plurality of apertures therein.

18. The dispensing assembly according to claim 15, wherein said flap means is hinged to said skirt at an upper end of said skirt.

* * * * *